US008668440B2

(12) United States Patent
Butler et al.

(10) Patent No.: US 8,668,440 B2
(45) Date of Patent: Mar. 11, 2014

(54) PLATFORM SEGMENT FOR SUPPORTING A NOZZLE GUIDE VANE FOR A GAS TURBINE AND NOZZLE GUIDE VANE ARRANGEMENT FOR A GAS TURBINE

(75) Inventors: David Butler, Nottingham (GB); Anthony Davis, Bassingham (GB); Charlotte Poole, Lincoln (GB); Paul Mathew Walker, Dunholme (GB)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/703,643

(22) PCT Filed: May 31, 2011

(86) PCT No.: PCT/EP2011/058910
§ 371 (c)(1), (2), (4) Date: Feb. 19, 2013

(87) PCT Pub. No.: WO2011/157549
PCT Pub. Date: Dec. 22, 2011

(65) Prior Publication Data

US 2013/0209217 A1 Aug. 15, 2013

(30) Foreign Application Priority Data

Jun. 17, 2010 (EP) ..... 10166299

(51) Int. Cl.
*F01D 5/08* (2006.01)

(52) U.S. Cl.
USPC ..... 415/116; 416/193 A

(58) Field of Classification Search
USPC ..... 415/1, 115, 116, 191, 208.1; 416/96 R, 416/97 R, 193 A
See application file for complete search history.

(56) References Cited

U.S. PATENT DOCUMENTS

| | | | | |
|---|---|---|---|---|
| 4,353,679 | A | 10/1982 | Hauser | |
| 5,545,002 | A * | 8/1996 | Bourguignon et al. | 415/115 |
| 5,615,546 | A | 4/1997 | Althaus | |
| 5,634,766 | A * | 6/1997 | Cunha et al. | 415/115 |
| 5,743,708 | A | 4/1998 | Brown | |
| 6,602,047 | B1 | 8/2003 | Barreto | |
| 8,226,360 | B2 * | 7/2012 | Scoggins et al. | 415/191 |
| 2007/0154312 | A1 | 7/2007 | Neuhoff | |

FOREIGN PATENT DOCUMENTS

| | | |
|---|---|---|
| EP | 0874131 A2 | 10/1998 |
| EP | 1022435 A2 | 7/2000 |
| EP | 1674661 A2 | 6/2006 |
| EP | 1022435 B1 | 6/2009 |
| FR | 2316440 A1 | 1/1977 |

* cited by examiner

*Primary Examiner* — Edward Look
*Assistant Examiner* — Liam McDowell

(57) ABSTRACT

A platform segment for supporting a nozzle guide vane for a gas turbine is provided. The platform segment includes a gas passage surface arranged to be in contact with a streaming gas exhausted from a combustor, wherein the streaming gas streams along the gas passage surface in a streaming direction, a cooling surface, opposite to and thermally connected to the gas passage surface and arranged to be in contact with a cooling fluid, a wall protruding from the cooling surface and extending at least partially in the streaming direction, wherein the wall is arranged circumferentially between positions, at which adjacent guide vanes are to be provided, such that cooling fluid is channeled by the wall for cooling a downstream portion of the cooling surface, and a further wall protruding from the cooling surface and extending at least partially in the streaming direction.

15 Claims, 4 Drawing Sheets

PLATFORM SEGMENT FOR SUPPORTING A NOZZLE GUIDE VANE FOR A GAS TURBINE AND NOZZLE GUIDE VANE ARRANGEMENT FOR A GAS TURBINE

CROSS REFERENCE TO RELATED APPLICATIONS

This application is the US National Stage of International Application No. PCT/EP2011/058910, filed May 31, 2011 and claims the benefit thereof. The International Application claims the benefits of European Patent Office application No. 10166299.7 EP filed Jun. 17, 2010. All of the applications are incorporated by reference herein in their entirety.

FIELD OF INVENTION

The present invention relates to a platform segment for supporting a nozzle guide vane for a gas turbine and to a nozzle guide vane arrangement for a gas turbine, wherein a cooling surface is provided at the platform segment for cooling at least a portion of the platform segment. Further, the present invention relates to a method for cooling a nozzle guide vane platform segment by using a cooling fluid channeled for cooling at least a portion of the nozzle guide vane platform segment.

ART BACKGROUND

A nozzle guide vane is a static segment of a gas turbine which guides gas exhausted from a combustor to a rotor blade located downstream the nozzle guide vane. The nozzle guide vane may be supported by a radially inner platform and by a radially outer platform. During operation of the gas turbine the nozzle guide vane as well as the platform supporting the nozzle guide vane may be subjected to a high temperature of the impinging gas exhausted from the combustor. In particular, the impinging gas may result in extensive oxidation of the material comprised in the platform for supporting the nozzle guide vane. Thereby, the operation lifetime of the platform may be limited.

In a conventional turbine the platform for supporting the nozzle guide vane may be manufactured with a thermal barrier coating to achieve longer lifetimes.

EP 1 674 661 discloses an internally cooled gas turbine engine turbine vane, wherein a cooling passage way is formed within the turbine vane.

U.S. Pat. No. 6,602,047 discloses an apparatus for cooling a gas turbine nozzle, wherein the nozzle comprises a first wall, a second wall and a plurality of pins extending there between. The nozzle also includes at least one row of turbulators.

EP 1 022 435 discloses an internal cooling circuit for a gas turbine bucket, wherein the internal cooling circuit has a serpentine configuration and includes rib segments.

U.S. Pat. No. 5,615,546 discloses an appliance for cooling a gas turbine combustion chamber, wherein connecting openings are arranged between adjacent cooling ducts.

There may be a need for a platform segment for supporting a nozzle guide vane for a gas turbine which has a longer lifetime compared to a conventional platform segment. Further, there may be a need for a platform segment for supporting a nozzle guide vane for a gas turbine which is less susceptible to impinging hot gas exhausted from a combustor compared to a conventional platform segment. Further, there may be a need for a nozzle guide vane arrangement for a gas turbine providing a longer operation lifetime compared to a conventional nozzle guide vane arrangement and providing also or alternatively less susceptibility to impinging or high temperature gas exhausted from a combustor.

Further, there may be a need for a method for cooling a nozzle guide vane platform segment, wherein the method is more effective and protects the nozzle guide vane platform segment in an improved way against high temperature impinging gas.

SUMMARY OF THE INVENTION

This need may be met by the subject matter according to the independent claims. Advantageous embodiments of the present invention are described by the dependent claims.

According to an embodiment a platform segment for supporting a nozzle guide vane for a gas turbine is provided, wherein the platform segment comprises a gas passage surface arranged to be in contact with a streaming gas exhausted from a combustor; a cooling surface opposite to and thermally connected to (or in thermal contact with) the gas passage surface and arranged to be in contact with (or in thermal contact with) a cooling fluid; and a wall protruding from the cooling surface and extending at least partially in a direction of the streaming gas, wherein the wall is arranged circumferentially between adjacent guide vanes such that cooling fluid is channeled for cooling a downstream portion of the cooling surface.

The gas turbine may comprise a compressor, at least one combustor, and one or more turbine sections or stages. The compressor may compress air which may be delivered to the combustor to be mixed with a fuel and burnt. The burnt mixture of fuel and compressed air may be directed or guided to the one or more turbine stages of the gas turbine. In particular, the first turbine stage of the gas turbine may comprise one or more nozzle guide vanes which may be arranged in an annular way. At the symmetry axis of the annularly arranged nozzle guide vanes the rotor shaft may be arranged at which plural rotor blades may be connected. The hot gas impinging on the nozzle guide vanes may be directed to the rotor blades which are arranged downstream of the nozzle guide vanes. The hot gas may impinge onto the rotor blades causing them to drive the rotor shaft. Thereby, mechanical energy may be generated from the gas exhausted from the combustor. The energy may for example be used to drive the compressor and/or to generate electric energy or another form of mechanical energy.

In particular, the first nozzle guide vane and the platform segment for supporting the nozzle guide vane may be subjected to high temperature operation gas during operation of the gas turbine. Thereby, the material from which the platform segment is manufactured may be chemically altered and/or mechanically altered such that the platform segment may be adversely effected, such as by extensive oxidation. The oxidation may then lead to a reduced performance and/or durability of the gas turbine.

In particular, the nozzle guide vane platform segment and the nozzle guide vane may be aligned with the one or more combustors, and therefore with the individual burners. There may be a limited number of burners or combustors arranged in an annular way around the rotation shaft. Thus, there may be some circumferential gas temperature variation, in particular causing different degrees of stress for platform segments located at different circumferential positions. In particular, the arrangement of combustors may result in the nozzle guide vane close to the burner being exposed to higher gas temperatures than other nozzle guide vanes located at different circumferential locations.

The impinging gas exhausted from the combustor may impinge onto the nozzle guide vane resulting in an especially heavy wear at a nozzle guide vane downstream edge portion of the platform segment supporting the nozzle guide vane. This downstream portion may also be referred to as trailing edge platform location.

The gas passage surface of the platform segment is in communication with a main gas (also referred to as operation gas) passage which streams in a streaming direction from upstream to downstream. Thus, the gas passage surface faces the hot gas expelled from the combustor. In contrast, the cooling surface does not face the gas expelled from the combustor, but is opposite to the gas passage surface. Nevertheless, the cooling surface may conduct heat away (or absorb) from the gas passage surface, as the cooling surface is thermally connected to the gas passage surface. Heat absorbed at the gas passage surface by the impinging hot gas expelled from the combustor may be conducted (in particular through a continuous material, such as a metal, of the platform segment) to the cooling surface which in turn is in contact with a cooling fluid. Thereby, the cooling fluid may absorb heat transferred from the gas passage surface to the cooling surface and may carry away the heat, thereby cooling the cooling surface and thereby also indirectly cooling the gas passage surface. The cooling fluid may in particular be a cooling gas, such as cooling air, in particular compressed cooling air. The cooling fluid (in particular the cooling air), may be delivered from the compressor comprised in the gas turbine or may alternatively or additionally be delivered from an external compressor.

In particular, the gas passage surface and the cooling surface may be opposite surfaces of a continuous single metal structure forming the platform segment. In particular, the platform segment may be a segment of an annular structure supporting a row of nozzle guide vanes. In particular, the platform segment may be a cylindrical segment, the platform assembled from plural segments having cylindrical symmetry.

The hot gas driving the gas turbine (also referred to as operation gas) may proceed or move directed by the nozzle guide vane(s) in a spiral like manner having an axial component and a circumferential component (when considering the rotation shaft axis as extending along the axial direction). The geometrical properties of the propagation path of the operation gas and also the density of the operation gas at different locations within the gas passage may subject in particular the downstream portion of the gas passage surface (located close to the downstream edge of the nozzle guide vane) to higher stress (higher temperature or heat transfer) than other regions of the gas passage surface. Thus, it may be advantageous to effectively cool the downstream portion of the cooling surface (corresponding to the downstream portion of the gas passage surface), in order to effectively conduct heat away from the downstream portion of the gas passage surface.

For effectively cooling the downstream portion of the cooling surface a wall is provided which causes channelling of the cooling fluid towards the downstream portion of the cooling surface. In particular, the cooling fluid may be delivered to a cavity (radially inwards or radially outwards of the platform segment) from where it may be directed towards the cooling surface. Thereby, the wall protruding from the cooling surface may cause channelling the cooling fluid along the cooling surface towards the downstream portion of the cooling surface.

The wall protruding from the cooling surface may be integrally formed when forming the platform segment. In particular, the platform segment may be manufactured by casting metal. The wall protruding from the cooling surface may protrude 1 mm to 10 mm, in particular 2 mm to 4 mm. The wall may protrude (along its extension) to a different extent from the cooling surface, wherein the extent of protrusion may vary along its extension from an upstream portion of the cooling surface to the downstream portion of the cooling surface.

In particular, the upstream portion of the cooling surface may correspond to (e.g. have similar axial position as) an upstream edge of the nozzle guide vane and the downstream portion of the cooling surface may correspond to the downstream edge of the nozzle guide vane. The wall may extend in a curved or wound or curving way mimicking a flow path of the operation gas within the operation gas passage. In particular, the wall may be shaped similarly as an upstream surface of the nozzle guide vane or a downstream surface of the nozzle guide vane. In particular, the wall may be similarly shaped as a cross-section of the upstream surface of the nozzle guide vane and/or the downstream surface of the nozzle guide vane.

Thereby, a heat transfer effectiveness from the cooling surface, in particular from the downstream portion of the cooling surface, caused by the cooling fluid may be improved. Thereby, the effectiveness of cooling the gas passage surface, in particular cooling the downstream portion of the gas passage surface, may be improved, thus prolonging the operation lifetime of the platform segment for supporting the nozzle guide vane.

According to an embodiment of the invention it is provided a platform segment for supporting a nozzle guide vane for a gas turbine, the platform segment comprising: a gas passage surface arranged to be in contact with a streaming gas exhausted from a combustor, wherein the streaming gas streams (or is supposed to stream, because of the structure of the platform segment and/or a shape of a guide vane provided at the platform segment) along the gas passage surface in a streaming direction (thus, the streaming direction being defined at the considered gas passage surface portion); a cooling surface opposite to and thermally connected to the gas passage surface and arranged to be in contact with a cooling fluid (for which cooling surface also the streaming direction is defined); a wall protruding (in particular opposite to the gas passage surface) from the cooling surface and extending at least partially in the streaming direction, wherein the wall is arranged circumferentially between positions, at which adjacent guide vanes are to be provided (or to be connected), such that cooling fluid (in particular propagating along the streaming direction) is channeled (and thus guided to flow along the streaming direction) by the wall for cooling a downstream portion of the cooling surface; and a further wall protruding from the cooling surface and extending at least partially in the streaming direction (i.e. extending approximately parallel to the wall), wherein a circumferential distance between the wall and the further wall decreases along the streaming direction (such that a cooling passage width of the cooling fluid decreases along the streaming direction).

In particular, the streaming direction is not globally defined to be constant across the entire gas turbine but is locally defined associated with a considered location of the gas passage surface, such that depending on the considereds location of the gas passage surface the streaming direction varies, in particular based on the geometry or structure of the gas passage surface (in particular together with the structure or shape of the connected nozzle guide vane adjacent to the considered location) at the considered location.

In particular the cooling fluid is channeled to flow between the wall and the further wall in the streaming direction.

In particular a nozzle guide vane having a pressure surface and a suction surface is to be provided (or connected) at the platform segment such that the pressure surface and the platform segment form a first edge along a first curved line (resembling a part of an airfoil profile of the guide vane) where the pressure surface and the platform segment join and such that the suction surface and the platform segment form a second edge along a second curved line (resembling another part of the airfoil profile of the guide vane) where the suction surface and the platform segment join.

In particular, the wall and/or the further wall may extend approximately parallel (deviation less than 30°, 20°, in particular 10°) to the first edge and/or the second edge such that the wall and/or the further wall causes to guide the cooling fluid to flow along the cooling direction parallel to an extension direction of the wall and/or further wall and parallel to the streaming direction.

In particular, the wall and/or the further wall may extend at least 70%, in particular at least 80%, further in particular at least 100%, of a length of the first edge and/or the second edge in the streaming direction, wherein the cooling fluid is channeled such that the cooling fluid changes a propagation direction by less than 60°, in particular less than 40°, further in particular less than 20°.

According to an embodiment the platform segment further comprises a turbulator, in particular arranged at the downstream portion of the cooling surface, the turbulator protruding from the cooling surface to a protrusion extent smaller than a protrusion extent of the wall, wherein the turbulator extends transversely, in particular orthogonally, to the extension direction of the wall. By providing the turbulator the cooling surface may be appropriately profiled to cause turbulence of the cooling fluid such that the cooling fluid interacts with the cooling surface to a higher degree, thus absorbing more heat energy from the cooling surface. Thereby in particular, the turbulator advantageously extends transversely to a propagation direction of the cooling fluid which may at least approximately be in the direction of the extension of the wall. In particular, turbulators may be situated or extend approximately 90° to the wall. Thereby, the cooling fluid, in particular the cooling air, may be kept swirling, thereby enhancing heat transfer from the cooling surface. In particular, the combination of the wall directing the cooling fluid and the turbulator may improve the overall cooling effectiveness of film holes opening to the trailing edge of the platform segment. Thereby, the film holes may be formed within the downstream portion of the gas passage surface of the platform segment, thus connecting the cavity to which the cooling fluid is delivered with the operation gas passage.

According to an embodiment one or more turbulators are present to still further improve the heat transfer from the cooling surface. In particular, the turbulators arranged at different portions of the cooling surface may extend in slightly different directions depending on the shape of the wall and/or the shape of the propagation path of the operation gas. In particular the turbulators may be straight.

According to an embodiment the protrusion extent of the wall amounts to between 3 times and 10 times, in particular between 4 times and 8 times, the protrusion extent of the turbulator. Thus, the protrusion extent of the wall is much greater than the protrusion extent of the turbulator. Thereby, the wall effectively channels the cooling fluid, whereas the turbulator causes a more turbulent flow of the cooling fluid, in particular the cooling air.

The further wall protruding from the cooling surface and extends at least partially in a direction of the streaming gas, wherein a circumferential distance between the wall and the further wall decreases along the streaming direction. Thus, the width of a channel limited by the wall and the further wall decreases from the upstream portion of the cooling surface to the downstream portion of the cooling surface. The decrease of the width of the channel may be in correspondence to a decrease of a cross-sectional width of the nozzle guide vane arranged circumferentially spaced apart from the channel (but at similar axial position). By the further wall the channelling to the downstream portion of the cooling surface may even be improved, thus improving heat transfer from the downstream portion of the cooling surface and thus also improving heat transfer away from the downstream portion of the gas passage surface to the cooling fluid.

According to an embodiment the turbulator extends from the wall to the further wall. Thus, the turbulator increases the turbulence of the cooling fluid in the whole region between the wall and the further wall for effectively causing or enhancing turbulence of the cooling fluid.

According to an embodiment the platform segment further comprises a cover arranged (in particular oppositely to the cooling surface) to be in contact with portions of the wall and the further wall protruding to a maximal extent from the cooling surface, thereby covering the cooling surface between the wall and the further wall. The cover may also be referred to as impingement plate, although the cover may not have a planar shape. In particular, the cover may comprise a shape having at least partially cylindrical symmetry. The cover may in particular close the channel formed between the wall and the further wall for even more effectively channelling the cooling fluid. In particular, the cover may comprise one or more holes through which the cooling fluid may enter the space between the cooling surface and a surface of the cover being in contact with at least portions of the wall and the further wall. Depending on cooling requirements the number and locations of the holes in the cover may be appropriately adjusted.

According to an embodiment the wall comprises a section protruding from the cooling surface to a maximal extent and a section protruding from the cooling surface between 0.2 times and 0.8 times, in particular between 0.4 times and 0.6 times, the maximal extent. Thereby, a so-called castellated wall may be provided. Also the further wall may be structured in a similar way. Thereby, in particular the portion of maximal protrusion extent may contact the cover, while the portion having a protrusion extent smaller than the maximal protrusion extent may not contact the cover. Thereby, openings between adjacent channels formed by the wall and the further wall may be provided which may allow the cooling fluid to exchange between adjacent channels such that an equal pressure of the cooling fluid may be ensured across all regions of the cavity between the cover and the cooling surface. Thereby, the cooling effectiveness may be improved.

In particular, the cooling fluid may be directed to the trailing edge of the platform segment, through the film cooling hole and may then be exhausted to the operation gas passage (main gas path). The geometry of the castellated wall may be adapted according to the particular application.

According to an embodiment the platform segment further comprises a nozzle guide vane connection member for connecting the nozzle guide vane such that it protrudes from the gas passage surface, the connection member comprising a rim protruding from the cooling surface. The rim may in particular have a similar structure or shape as the cross-section of the nozzle guide vane. The rim may in particular protrude by a similar amount as the wall and/or the further wall. Further, the rim may comprise a rim portion corresponding to the upstream surface of the nozzle guide vane and may comprise a rim portion corresponding to the downstream surface of the nozzle guide vane. In particular, the upstream rim portion and/or the downstream rim portion of the connection member may be shaped in a similar way as the wall and the further wall.

According to an embodiment the rim may be a consequence of casting the platform segment.

According to an embodiment the platform segment further comprises a cooling fluid entry hole surrounded by the rim of the connection member for allowing cooling fluid entering an inside of the nozzle guide vane. Thereby, the nozzle guide vane may be effectively cooled by the cooling fluid entering the inside of the nozzle guide vane through the cooling fluid entry hole.

According to another embodiment the hole may be blanked off by the end of the impingement tube. Thus the hole may not be present.

According to an embodiment the downstream portion of the cooling surface is axially arranged close to a downstream portion of the rim of the connection member, wherein the downstream portion of the cooling surface is in particular axially arranged less than 0.2 times an axial extent of the rim of the connection member away from the downstream portion of the rim of the connection member. Thereby, the downstream portion of the cooling surface may located where the gas passage surface of the platform segment may be subjected to the highest wear due to the high temperature operation gas. The highest wear in particular may occur at the trailing (downstream) edge platform location, as mentioned and detailed above.

According to an embodiment the platform segment is adapted for supporting the nozzle guide vane which is arranged radially outwards from the platform segment. Thereby, a radially inner platform segment may be provided.

According to an alternative embodiment the platform segment is adapted for supporting the nozzle guide vane which is arranged radially inwards from the platform segment. Thereby, a radially outer platform segment may be provided. In particular, a platform segment located radially outwards of the nozzle guide vane and a platform segment located radially inwards from the platform segment may be provided, both platform segments supporting the nozzle guide vane and being cooled by the cooling fluid contacting a cooling surface in each of the two platform segments.

According to an embodiment a nozzle guide vane arrangement for a gas turbine is provided, wherein the arrangement comprises at least one platform segment for supporting a nozzle guide vane according to an embodiment as described above; and a nozzle guide vane connected to the platform segment such that the nozzle guide vane protrudes from the gas passage surface of the platform segment. In particular, the platform segment as well as the nozzle guide vane may be cooled using a common supply of a cooling fluid, in particular cooling air.

According to an embodiment a method for cooling a nozzle guide vane platform segment is provided, wherein the method comprises exhausting a streaming gas from a combustor; contacting a gas passage surface of the platform segment with the streaming gas; contacting a cooling surface opposite to and thermally connected to the gas passage surface with a cooling fluid; and channelling the cooling fluid for cooling a downstream portion of the cooling surface by a wall protruding from the cooling surface and extending at least partially in a direction of the streaming gas arranged circumferentially between adjacent guide vanes.

It has to be noted that embodiments of the invention have been described with reference to different subject matters. In particular, some embodiments have been described with reference to method type claims whereas other embodiments have been described with reference to apparatus type claims. However, a person skilled in the art will gather from the above and the following description that, unless other notified, in addition to any combination of features belonging to one type of subject matter also any combination between features relating to different subject matters, in particular between features of the method type claims and features of the apparatus type claims is considered as to be disclosed with this document.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
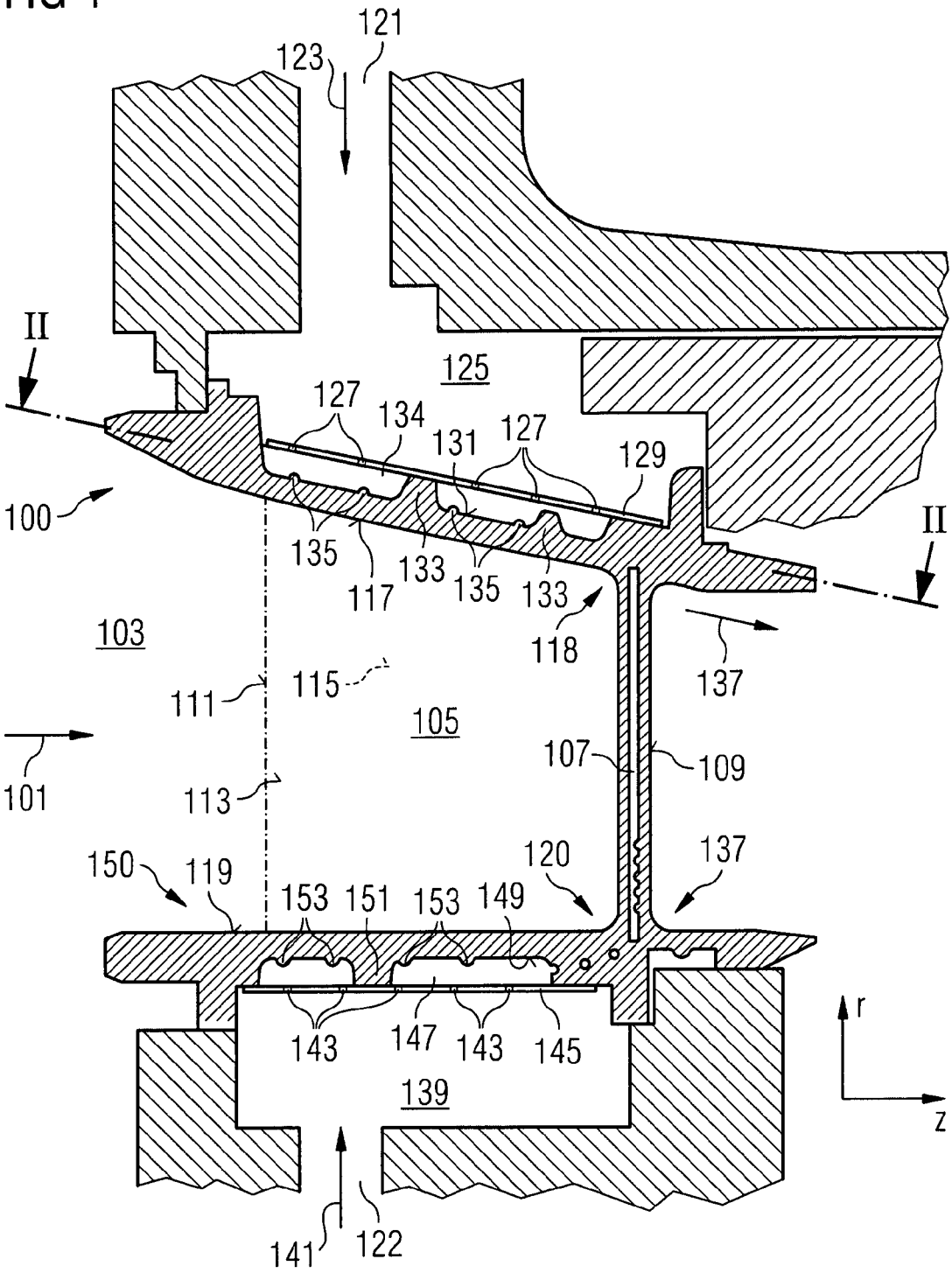
FIG. 1 schematically shows a cross-sectional view of a portion of a gas turbine including a platform segment for supporting a nozzle guide vane according to an embodiment.

The illustration in the drawing is schematically. It is noted that in different figures, similar or identical elements are provided with the same reference signs or with reference signs, which are different from the corresponding reference signs only within the first digit.

FIG. 1 schematically illustrates a cross-sectional view of a portion of a gas turbine including a radially outer platform segment 100 for supporting a nozzle guide vane according to an embodiment and a radially inner platform segment 150 for supporting a nozzle guide vane according to an embodiment. An operation gas exhausted from a combustor upstream of the outer platform segment 100 and the inner platform segment 150 propagates along a direction indicated by reference sign 101. A not indicated rotation axis lies within the drawing plane of FIG. 1 in a horizontal orientation.

By the direction 101 of the streaming or flowing operation gas an upstream side of a component of the turbine may be defined as that side of the component to which the flowing operation gas is directed to. Further, a downstream side of a component of the turbine may be defined as that side of the component from which the flowing operation gas is directed away. The operation gas flowing in the direction 101 propagates in an operation gas passage 103 between the outer platform segment 100 and the inner platform segment 150. Within the operation gas passage 103 a guide vane 105 is arranged from which in the sectional view of FIG. 1 only a downstream portion 107 is illustrated, wherein the downstream portion 107 of the nozzle guide vane 105 comprises a downstream edge 109 of the guide vane 105. As a broken line 111 the upstream edge of the nozzle guide vane 105 is illustrated which, however, is situated in a cross-section different from the cross-section illustrated in FIG. 1.

The nozzle guide vane 105 comprises an upstream surface 113 facing the streaming operation gas and a downstream surface 115 opposite to the upstream surface 113 such that the operation gas does not directly impinge onto the downstream surface 115. The upstream surface 113, the downstream surface 115, the upstream edge 111 and the downstream edge 109 together have a shape of an airfoil. By this particular airfoil shape of the nozzle guide vane 105 the operation gas flowing along the direction 101 is deflected and directed to not illustrated rotor blades arranged further downstream the nozzle guide vane 105, in particular further downstream the downstream edge 109 of the nozzle guide vane 105.

The nozzle guide vane 105 is supported by the platform segment 100 arranged at a larger radius r (i.e. radially outwards) and is supported at a smaller radius r (radially inwards) by the inner platform segment 150. The guide vane 105 may be connected to the platform segment 100 and to the platform segment 150 for example by clamping, welding or may be integrally formed with the segments 100 and/or 150.

During operation the operation gas impinging onto the nozzle guide vane 105 as well as impinging onto an outer gas passage surface 117 of the outer platform segment 100 and also impinging onto an inner gas passage surface 119 of the inner platform segment 150 transfers heat to the surfaces and components. Thereby, in a conventional turbine damage may occur, in particular by extensive oxidation.

Thereby, in particular a downstream portion 118 of the outer gas passage surface 117 and a downstream portion 120 of the inner gas passage surface 119 are subjected to especially high temperature and/or stress and/or wear by the impinging operation gas.

For cooling the outer gas passage surface 117 a cooling gas is delivered through a cooling entry passage 121 along a direction 123. The cooling gas enters a cavity 125 and passes through holes 127 in an impingement plate 129. The impingement plate 129 covers an outer cooling surface 131 such that a space 134 filled with cooling air is formed between the impingement plate 129 and the outer cooling surface 131.

From the cooling surface 131 a wall 133 protrudes towards the impingement plate 129, wherein in the cross-sectional view of FIG. 1 only portions of the wall 133 are illustrated. Other portions of the wall 133 are located at different cross-sectional locations not visible in FIG. 1. The wall 133 extends at least partially in a direction corresponding to the direction of the operation gas flowing in the direction indicated by reference sign 101. By the wall 133 the cooling air having entered the space 134 between the impingement plate 129 and the outer cooling surface 131 is directed along the outer cooling surface 131 for absorbing heat from the cooling surface 131 which heat has been conducted from the outer gas passage surface 117 through the material of the outer platform segment 100 to the outer cooling surface 131. Further, by the arrangement and geometry of the wall 133 the cooling gas is conducted or channeled towards a downstream region of the cooling surface 131 which is opposite to the downstream region 118 of the outer gas passage surface 117. Thereby, heat deposited or delivered by the operation gas to the downstream region 118 of the outer gas passage surface 117 is conducted through the material of the outer platform segment 100 to the downstream portion of the cooling surface 131, wherein the heat may be effectively transferred to the cooling air which may carry away at least a portion of the heat energy.

To further enhance the capacity of heat transfer from the cooling surface 131 to the cooling air a number of turbulators 135 are provided protruding from the outer cooling surface 131 to a smaller extent than the protrusion extent of the wall 133. The turbulators 135 extend transversely, in particular orthogonally, to the extent of the wall 133, to effectively increase the turbulence of the cooling air flowing within the space 134 between the impingement plate 129 and the outer cooling surface 131. Thereby, the cooling air interacts more strongly (or with higher rate) with the cooling surface 131 and may absorb a larger amount of heat energy from the outer cooling surface 131, thereby more effectively cooling the outer gas passage surface 117. By not illustrated holes in the outer platform segment 100 (at a downstream portion thereof) the cooling air may exit the space 134 between the impingement plate 129 and the outer cooling surface 131 along a direction labelled by reference sign 137.

For cooling the inner gas passage surface 119 cooling air enters a cavity 139 through a cooling entry passage 122 along a direction labelled by reference sign 141. Through holes 143 the cooling air passes through another impingement plate 145 to enter a space 147 between the impingement plate 145 and an inner cooling surface 149. From the cooling surface 149 at least one wall 151 protrudes towards the impingement plate 145 which is however not fully visible in the cross-section illustrated in FIG. 1.

Further, to increase cooling capacity, turbulators 153 protrude from the inner cooling surface 149 to enhance heat transfer from the cooling surface 149 to the cooling air. Thereby, heat energy received from the operation gas at the inner gas passage surface 119 which heat energy is conducted through the inner platform segment 150 towards the inner cooling surface 149 may be carried away by the cooling air. Thereby, the operation lifetime of the inner gas passage surface 119 and the outer gas passage surface 117 may be enhanced.

Figure 2:
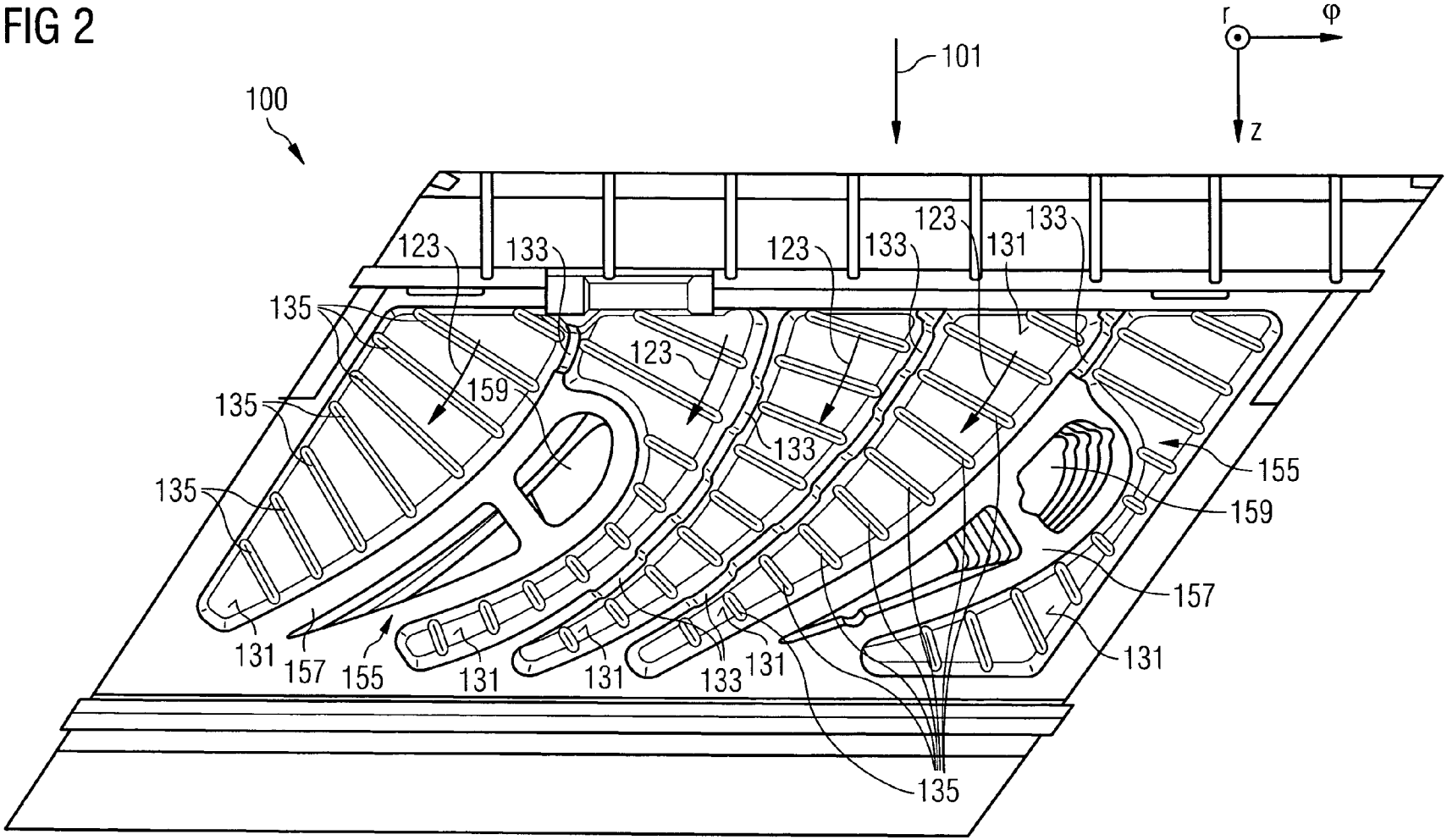
FIG. 2 illustrates a rolled out plan view of the radially outer platform segment for supporting a nozzle guide vane included in FIG. 1.

FIG. 2 illustrates a plan view (looking radially inwards) of the outer platform segment 100 illustrated in FIG. 1, wherein the outer platform segment 100 is seen when looking inwards towards the centre line of the gas turbine. The axial direction (z-direction) lies in the drawing plane running vertically downwards in FIG. 2 and the radial direction (r-direction) is perpendicular of the drawing plane of FIG. 2. The operation gas propagates along the direction 101 (having at least a component in the axial direction). The cooling air is introduced along the direction 123 and is directed or channeled along the outer cooling surface 131 between adjacent walls 133. In particular, the walls 133 are castellated directional vertical walls protruding from the outer cooling surface 131 to channel the cooling gas towards a downstream portion of the outer cooling surface 131 in a lower portion of FIG. 2.

In the embodiment illustrated in FIG. 2 two castellated walls 133 are arranged circumferentially (along the ($\phi$-direction) between connection members 155 of two adjacent nozzle guide vanes 105. In particular, the connection members 155 comprise each a rim 157 protruding from the outer cooling surface 131 about a same extent as the maximal protrusion extent of the castellated walls 133. The rim 157 of the connection members 155 surrounds a cooling fluid entry hole 159 for supplying cooling air to an inside of the nozzle guide vane 105. In particular, the castellated walls 133 extend in a curved manner similar as the airfoil profile of the nozzle guide vane 105 as seen in a cross-sectional view close to the outer gas passage surface 117.

It should be noted that the connection member 155 and the rim 157 may be a consequence of casting and may not be an essential part of an embodiment of the platform.

Figure 3:
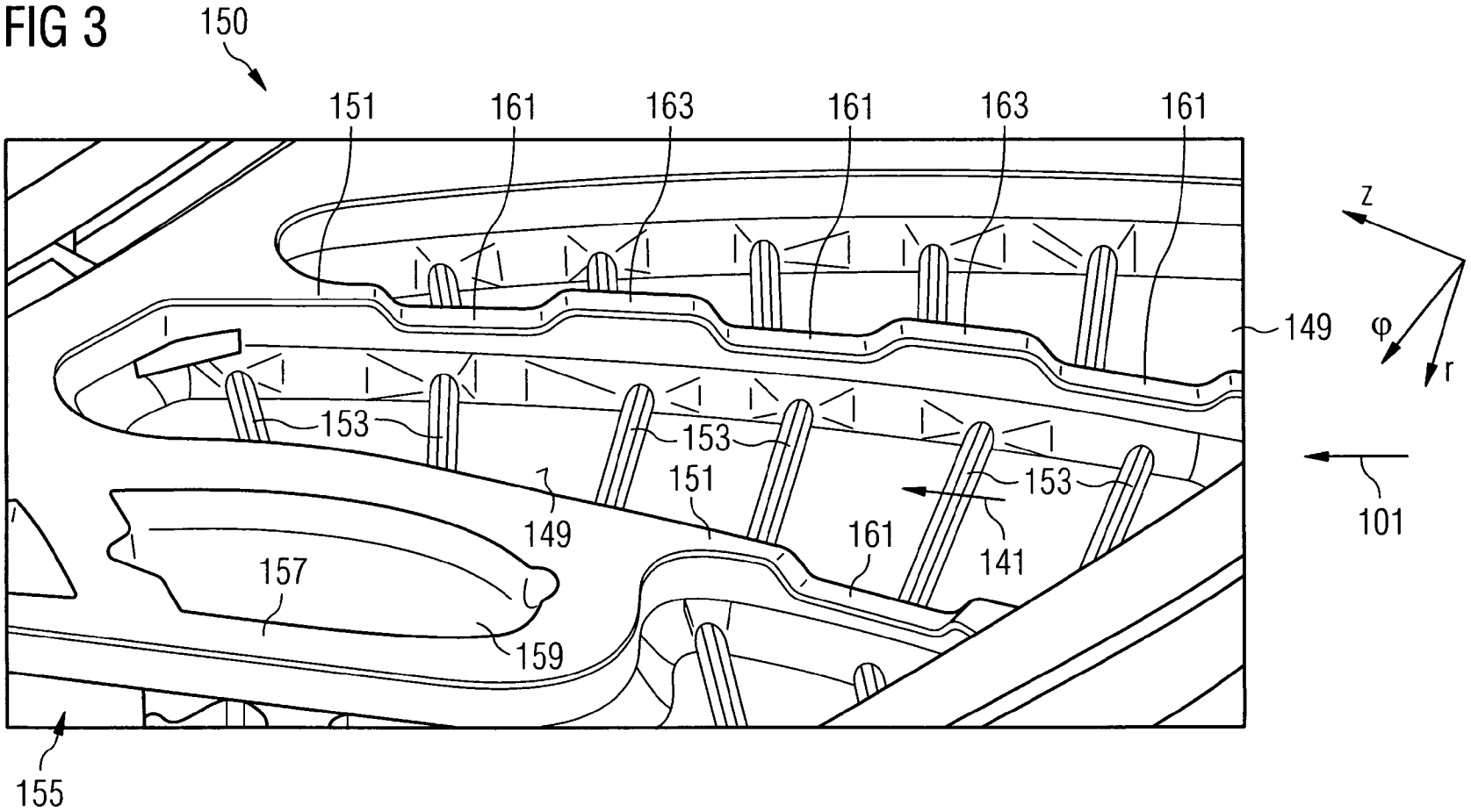
FIG. 3 illustrates a perspective view of the radially inner platform segment for supporting a nozzle guide vane included in FIG. 1.

FIG. 3 illustrates a perspective view of a portion of the inner platform segment 150 illustrated in FIG. 1 without the inner impingement plate 145 in order to illustrate the inner cooling surface 149 and the structures applied thereon in more detail. The approximate orientation of the cylinder coordinate system is indicated. The cooling air flows along a direction 141 along the inner cooling surface 149 between castellated walls 151. The castellated wall 151 comprises portions 161 which protrude to a small extent from the inner cooling surface 149 and the castellated wall 151 comprises portions 163 protruding to a larger extent from the inner cooling surface 149 than the portions 161. In particular, the portions 161 and 163 alternate along the extension direction of the castellated wall 151.

In operation, when the impingement plate 145 is applied for covering the inner cooling surface 149 the portions 163 of the castellated wall 151 protruding to a maximal extent from the inner cooling surface 149 contact the impingement plate 145, while the portions 161 of the castellated wall 151 do not contact the impingement plate 145, but maintain a gap between the impingement plate 145 and an upper surface of the portions 161 such that cooling air may distribute through these gaps between adjacent cooling air channels separated by the castellated walls 151. Thereby, equal pressure of the cooling air across all regions of the space between the impingement plate 145 and the inner cooling surface 149 may be ensured.

The structure of the castellated wall 133 of the outer platform segment 100 illustrated in FIG. 2 is structured in a similar way having portions protruding to a maximal protrusion extent and portions protruding to an extent smaller than the maximal protruding extent and being arranged in an alternating way along the extension of the castellated walls 133.

Figure 4:
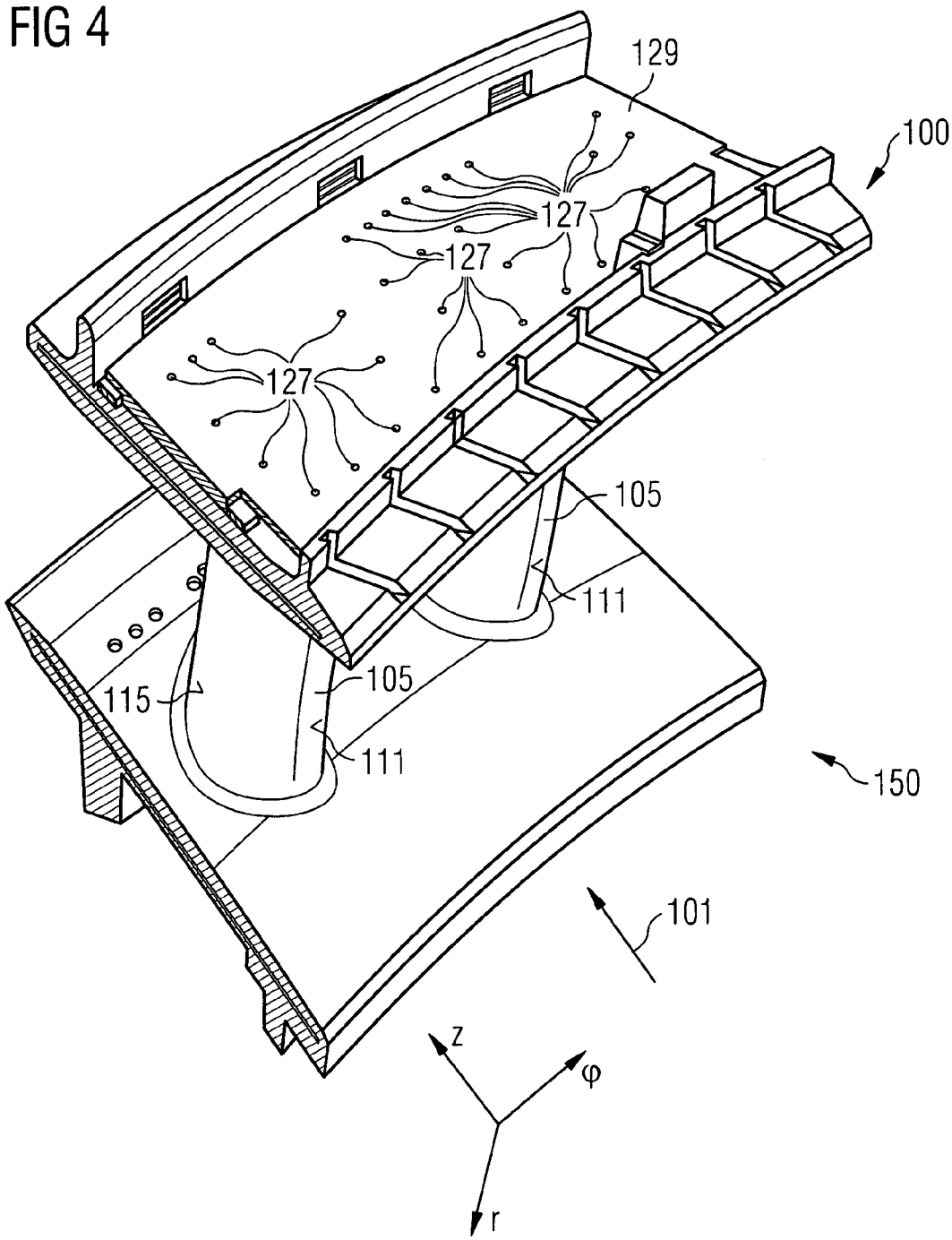
FIG. 4 illustrates a perspective view of the portion of the gas turbine illustrated in FIG. 1 including the radially outer platform segment and the radially inner platform segment for supporting nozzle guide vanes.

FIG. 4 illustrates a perspective view of the portion of the gas turbine illustrated in FIG. 1 including the outer platform segment 100 and the inner platform segment 150 and including also two nozzle guide vanes 105. At the outer platform segment 100 the impingement plate 129 covers the outer cooling surface 131 which is therefore not visible in the illustration of FIG. 4. The impingement plate 129 comprises the holes 127 for allowing cooling air to pass through the impingement plate 129 into the space 134 between the impingement plate 129 and the outer cooling surface 131, as depicted in FIG. 1.

The new design of the cooling surfaces 131, 149 having the turbulators 135, 153 and castellated walls 133, 151 may improve the cooling effectiveness to the trailing edge platform location 118, 120 by means of the new cooling features that may be applied to both the inner platform cavity 147 and the outer platform cavity 134. The castellated walls 133, 151 may support the impingement plates 129, 145 and may ensure that an equal pressure across all regions of the cavities 134, 147 is ensured. Thus, this may improve to direct the flow of cooling air to the trailing edge of the outer platform and the inner platform. From there, the cooling air may pass through film cooling holes and may then be exhausted to the main gas path or gas passage 103. The turbulators 135, 153 may be arranged approximately 90° to the castellated walls 133, 151 to keep the cooling air swirling and thereby enhancing heat transfer from the cooling surfaces 131, 149. The combination of these two cooling features may improve the overall cooling effectiveness of the film holes to the trailing edge of the platform.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

In order to recapitulate the above described embodiments of the present invention one can state:

The invention claimed is:

1. A platform segment for supporting a nozzle guide vane for a gas turbine, the platform segment comprising:

a gas passage surface arranged to be in contact with a streaming gas exhausted from a combustor, wherein the streaming gas streams along the gas passage surface in a streaming direction;

a cooling surface opposite to and thermally connected to the gas passage surface and arranged to be in contact with a cooling fluid;

a wall protruding from the cooling surface and extending at least partially in the streaming direction, wherein the wall is arranged circumferentially between positions, at which adjacent guide vanes are to be provided, such that cooling fluid is channeled by the wall for cooling a downstream portion of the cooling surfaces; and a further wall protruding from the cooling surface an extending at least partially in the streaming direction, wherein a circumferential distance between the wall and the further wall decreases along the streaming direction, wherein the nozzle guide vane having a pressure surface and a suction surface is connectable at the platform segment such that the pressure surface and the platform segment form a first edge along a first curved line where the pressure surface and the platform segment join, the first curved line resembling a part of an airfoil profile of the guide vane and such that the suction surface and the platform segment form a second edge along a second curved line where the suction surface and the platform segment join the second line resembling another part of the airfoil profile of the guide vane, wherein the wall and the further wall extend approximately parallel to the first edge and the second edge, wherein a width of a channel limited by the wall and the further wall decreases from an upstream portion of the cooling surface to the downstream portion of the cooling surface, wherein the upstream portion of the cooling surface has a similar axial position as an similar axial position as a downstream edge of the nozzle guide vane, wherein the wall comprises a first section protruding from the cooling surface to a maximal extent and a second section protruding from the cooling surface between 0.2 times and 0.8 times the maximal extent.

2. The platform segment according to claim 1, further comprising a turbulator protruding from the cooling surface to a first protrusion extent smaller than a second protrusion extent of the wall, wherein the turbulator extends transversely to the extension direction of the wall.

3. The platform segment according to claim 2, wherein the turbulator is arranged at the downstream portion of the cooling surface.

4. The platform segment according to claim 2, wherein the turbulator extends orthogonally to the extension direction of the wall.

5. The platform segment according to claim 2, wherein the second protrusion extent of the wall amounts to between 3 times and 10 times the first protrusion extent of the turbulator.

6. The platform segment according to claim 5, wherein the second protrusion extent of the wall amounts to between 4 times and 8 times the first protrusion extent of the turbulator.

7. The platform segment according to claim 2, wherein the turbulator extends from the wall to the further wall.

8. The platform segment according to claim 1, further comprising a cover arranged to be in contact with portions of the wall and the further wall protruding to a maximal extent from the cooling surface, thereby covering the cooling surface between the wall and the further wall.

9. The platform segment according to claim 1, wherein the second section protrudes from the cooling surface between 0.4 times and 0.6 times the maximal extent.

10. The platform segment according to claim 1, further comprising:

a nozzle guide vane connection member for connecting the nozzle guide vane such that it protrudes from the gas passage surface, the connection member comprising a rim protruding from the cooling surface.

11. The platform segment according to claim 10, further comprising:

a cooling fluid entry hole surrounded by the rim of the connection member for allowing cooling fluid entering an inside of the nozzle guide vane.

12. The platform segment according to claim 10, wherein the downstream portion of the cooling surface is in particular axially arranged less than 0.2 times an axial extent of the rim of the connection member away from the downstream portion of the rim of the connection member.

13. The platform segment according to claim 1, wherein the platform segment is adapted for supporting the nozzle guide vane which is arranged radially outwards from the platform segment.

14. The platform segment according to claim 1, wherein the platform segment is adapted for supporting the nozzle guide vane which is arranged radially inwards from the platform segment.

15. A nozzle guide vane arrangement for a gas turbine, the arrangement comprising:

a platform segment according to claim 1; and a nozzle guide vane connected to the platform segment such that the nozzle guide vane protrudes from the gas passage surface of the platform segment.

* * * * *